US009314110B2

(12) United States Patent
Ahlqvist

(10) Patent No.: US 9,314,110 B2
(45) Date of Patent: Apr. 19, 2016

(54) BACKFOLDED POCKET MATTRESS

(71) Applicant: Stjernfjädrar AB, Herrljunga (SE)

(72) Inventor: Robert Ahlqvist, Vargarda (SE)

(73) Assignee: STJERNFJADRAR AB, Herrljunga (SE)

( * ) Notice: Subject to any disclaimer, the term of this patent is extended or adjusted under 35 U.S.C. 154(b) by 0 days.

(21) Appl. No.: 14/648,923

(22) PCT Filed: Dec. 12, 2013

(86) PCT No.: PCT/EP2013/076319

§ 371 (c)(1),
(2) Date: Jun. 2, 2015

(87) PCT Pub. No.: WO2014/095550

PCT Pub. Date: Jun. 26, 2014

(65) Prior Publication Data

US 2015/0313371 A1 Nov. 5, 2015

(30) Foreign Application Priority Data

Dec. 19, 2012 (EP) ..... 12198084

(51) Int. Cl.
*A47C 27/06* (2006.01)
*A47C 27/07* (2006.01)
*B68G 9/00* (2006.01)

(52) U.S. Cl.
CPC ..... *A47C 27/064* (2013.01); *A47C 27/063* (2013.01); *B68G 9/00* (2013.01); *A47C 27/07* (2013.01)

(58) Field of Classification Search
CPC ..... A47C 27/064; A47C 27/04; A47C 27/06; A47C 27/063; A47C 27/07
USPC ..... 5/720, 716, 717, 739, 655.8, 655.7, 5/654.1, 642; 267/91
See application file for complete search history.

(56) References Cited

U.S. PATENT DOCUMENTS 1,382,462 A 6/1921 Bills
1,915,957 A 6/1933 Schneider et al.
(Continued)

FOREIGN PATENT DOCUMENTS

FR 2932658 A1 12/2009
WO WO-01/02747 A1 1/2001
WO WO-2005-055771 A1 6/2005

OTHER PUBLICATIONS

International Search Report PCT/ISA/210 for International Application No. PCT/EP2013/076319 dated Mar. 3, 2014.

*Primary Examiner* — Robert G Santos
(74) *Attorney, Agent, or Firm* — Harness, Dickey & Pierce, P.L.C.

(57) ABSTRACT

A pocket mattress includes coil springs arranged as spring units, arranged successively in elongate strings, enclosed in a covering material forming pockets. A plurality of the strings are arranged side by side, the strings including a plurality of transverse seams arranged parallel to the longitudinal direction of the coil springs to separate the pockets. A middle portion of the transverse seams attaches at least a layer of covering material from either side of the spring unit to each other. At least some of the seams are back folded seams, in which the covering material proximate to an end portion of the back folded seams is back folded towards the middle portion of the transverse seams. As such, the back folded transverse seams each have at least one end portion attaching at least twice as many layers of covering material as in a corresponding transverse seam which is not back folded.

10 Claims, 4 Drawing Sheets

(56) References Cited

U.S. PATENT DOCUMENTS

| | | | | | |
|---|---|---|---|---|---|
| 1,995,641 | A | | 3/1935 | Kaiser | |
| 2,113,457 | A | | 4/1938 | Zeier | |
| 4,854,023 | A | | 8/1989 | Stumpf | |
| 5,957,438 | A | * | 9/1999 | Workman | A47C 27/063 267/90 |
| 6,036,181 | A | * | 3/2000 | Workman | A47C 27/063 112/475.08 |
| 6,085,397 | A | * | 7/2000 | Workman | A47C 27/063 267/90 |
| 6,098,968 | A | * | 8/2000 | Workman | A47C 27/063 267/90 |
| 6,295,673 | B1 | * | 10/2001 | Mossbeck | A47C 27/064 5/655.8 |
| 6,499,275 | B1 | | 12/2002 | Graf et al. | |
| 6,574,811 | B1 | * | 6/2003 | Mossbeck | A47C 27/064 5/655.8 |
| 2007/0124865 | A1 | | 6/2007 | Stjerna | |
| 2014/0373280 | A1 | * | 12/2014 | Mossbeck | A47C 27/053 5/718 |
| 2014/0373281 | A1 | * | 12/2014 | Mossbeck | A47C 27/053 5/718 |
| 2014/0373282 | A1 | * | 12/2014 | Mossbeck | A47C 27/064 5/720 |
| 2015/0313371 | A1 | * | 11/2015 | Ahlqvist | B68G 9/00 5/720 |

* cited by examiner

BACKFOLDED POCKET MATTRESS

TECHNICAL FIELD OF THE INVENTION

The present invention relates to a pocket mattress comprising coil springs enclosed in pockets, as well as a method and a device for manufacturing such a mattress.

BACKGROUND OF THE INVENTION

A common technique of manufacturing spring mattress is one known as the pocket technique. According to this technique, the springs are enclosed in pockets, i.e. they are enclosed individually by a covering material. In this way, the springs will be relatively individually resilient so that they can flex individually without affecting the neighboring springs and, thus, the comfort to the user increases since his/her weight will thus be distributed more uniformly of the surface that receives the load.

One drawback of such mattresses is, however, that the each pocket when expanded with a coil spring generally creates a portion of covering material protruding from the surface of the spring mattress, commonly known as "false lofts". These protruding portions of covering material create an uneven surface of the pocket mattress and do not contribute to improve the comfort of the pocket mattress. On the contrary, this may lead to that different parts of the pocket mattress become depressed to different degrees, during use, such that the surface of the pocket mattress becomes lumpy and not as comfortable. The unevenness and deformation of the surface also provides an appearance of a fairly old and worn mattress, already of a very short period of use. An additional problem that arises from a mattress surface with false lofts is that it may be difficult to attach an additional layer, such as a padded layer, to the surface, since there is a risk that the additional layer just becomes attached to the false lofts. The padded layer may be for example a polyester sheet. Hereby, the additional layer not only becomes poorly adhered to the pocket mattress, but also there is a significant risk of deformation, folding and unevenness of the additional layer. Thus, by attaching an additional layer to the pocket mattress, the problems mentioned above may be aggravated.

Consequently, there is need for a mattress which alleviates or avoids the problems mentioned above.

SUMMARY OF THE INVENTION

It is therefore an object of the present invention to at least partly overcome these problems, and to provide an improved pocket mattress with a smooth even surface, avoiding false lofts, with back folded transverse seams.

One of the objects of the present invention therefore is to provide a pocket mattress of the kind defined in the introduction, a method and a device for manufacturing said mattress, by means of which the disadvantages referred to above are completely or at least partly removed.

This object is achieved in a pocket mattress and by means of a method and a device for manufacturing said pocket mattress in the manner defined in the appended claims. These and other object will be apparent in the following.

According to a first aspect of the invention there is provided a pocket mattress comprising coil springs arranged as spring units enclosed in a covering material forming pockets, the spring units being arranged successively in elongate strings, the mattress comprising a plurality of such interconnected strings arranged side by side, wherein the elongate strings have a plurality of transverse seams arranged parallel to the longitudinal direction of the coil springs to separate the pockets, wherein a middle portion of the transverse seams attaches at least a layer of covering material from either side of the spring unit to each other, characterized in that at least some of the transverse seams are back folded transverse seams, in which the covering material in proximity to an end portion of the back folded transverse seams is back folded towards the middle portion of the transverse seams, whereby the back folded transverse seams each have at least one end portion attaching at least twice as many layers of covering material as in a corresponding transverse seam which is not back folded.

The present invention is based on the insights that a pocket mattress may be provided which has an even surface, and avoiding the problems with false lofts, by back folding the covering material back towards the elongate string attaching the back folded covering material with seams. It has been found that by such a back folding, a very smooth and planar surface of the pocket mattress is achievable, completely, or at least partly, avoiding any protruding "false lofts". Hereby, an improved comfort is obtained, and in addition, attachment of additional layers is made simpler and better. The mattress is also less prone to be deformed in various ways, thereby maintaining a nice appearance for a much longer time. Further, the solution is relatively simple and enables cost-efficient production. For example, this step may e.g. be obtained as an in-line step in conventional automated pocket mattress manufacturing.

"False lofts" should be in the following be construed as covering material protruding from the surface of the pocket mattress and or pocket strings, thereby creating an uneven surface which may cause a reduction of the comfort and less pleasing visual appearance. By achieving a pocket mattress with an even surface, the pocket mattress will be more comfortable and last longer during use without the pocket mattress becoming depressed differently across the surface creating a bubbly appearance. Furthermore, the pocket mattress will also enhance the perception of a well-made pocket mattress.

In the context of the present application, "the backfolded transverse seams" should be construed as transverse seams fixing twice as many layers of covering material at the end portion(s) as in a corresponding transverse seam which is not provided with such back folding. In most cases, this also means that the back folded transverse seams, at the back folded end portion(s) fixates essentially twice as many layers of covering material as in a middle portion of the transverse seams. The back folded transverse seams thus reduces protruding covering material. The twice as many layers of covering material are a result of back folded covering material being back folded in proximity to the end portions of successive springs in the longitudinal direction of the coil springs. In the case, where the transverse seam generally attaches two layers of covering material, the back folded transverse seams may attach at least four layers of covering material.

The middle portion of the transverse seams should be construed as a portion of the transverse seams in proximity to a centerline along the longitudinal direction of the elongate string. The folded back covering material would if not back folded towards a centerline of the elongate string create false lofts. The false lofts may arise by enclosing coil springs in rectangular pockets.

The back folding in the back folded transverse seams may be arranged at one or both end portions of the elongate string in the transverse direction. The longitudinal direction of the springs should in the following be construed as the compression direction of the springs. The springs are, when enclosed in the elongated string, arranged such that the longitudinal direction of the spring coincides with the transverse direction of the transverse seams of the elongate string.

The back folded covering material may, preferably, be folded in between layers of the covering material enclosing the coil springs. However, the back folded covering material may also be folded to an outer side of the covering material.

The elongate string should in the following be construed as a strip of covering material arranged to cover the springs in pocket such that springs are arranged in succession. The elongate string may comprise a strip or sheet of folded covering material. However, the elongate string may also be comprised of two assembled stripes/sheets, a tubular shaped covering material, or any other covering shape that may be able to cover the springs in pockets in succession.

The transverse seams and the back folded transverse seams may be formed through any form of adhesive bonding, welding, stapling, sewing, or any combination thereof. In a preferred embodiment, welding is used.

According to one example embodiment of the invention, at least one of the back folded transverse seams may have a first end portion and a second end portion both attaching at least twice as many layers of covering material as in a corresponding transverse seam which is not back folded. Back folding the covering material in proximity to the first and the second end portion of the back folded transverse seams facilitates a pocket mattress with two smooth and even surfaces. This is for example advantageous when the mattress is intended to be used with both sides up, i.e. a turnable mattress.

According to one example embodiment of the invention, the elongate strings may be made of a covering material with a constant width. By being able to use covering material with a constant width, e.g. in the form of rectangular strips of covering material, for the elongate strings, the mattress becomes both easier and less expensive to manufacture.

The elongate string may further include a longitudinal seam arranged to seal the covering material covering the successive springs in the spring units. The longitudinal seam may be located in proximity to the centerline of the elongate string or at the end portion of the transverse direction of the elongate string or anywhere in between. In case longitudinal seams are arranged at an end portion of the strings, it is preferred to arrange the back folding at the opposite end.

According to an example embodiment of the invention, the pocket mattress may further comprise a layer attached to a surface of the pocket mattress having back folded transverse seams. One of the advantages with having an even surface is that additional layers may be attached directly to the surface of the pocket mattress reducing the risk of deformation and/or displacement of the layer, which may arise when a layer is attached to the false lofts. The layer may be attached through any type of attachment means, such as, adhesives, staples, welding, seams, or any combination thereof. The layer may be made of any type, such as a padded layer including foam-like material, such as a polyester sheet, latex, felt, or any other upholstery material. The layer may also be a thin protective sheet or the like.

According to another aspect of the invention, there is provided a device for manufacturing a spring mattress comprising means for providing a covering material forming an elongate string, means for arranging coil springs in succession in such a manner that they are enclosed by the covering material, means for providing a transverse seam separating each coil spring in enclosed pockets, and means for interconnecting a plurality of parallel strings side by side by surface attachment between abutting surfaces, wherein it further comprises means for providing at least some of the transverse seams as back folded transverse seams by back folding covering material in proximity to at least one end portion of each back folded transverse seam towards a middle portion of the transverse seams. The covering material is back folded towards the centerline of the elongate string in the transverse direction of the elongate string.

The device for manufacturing a pocket string comprises the same or similar advantages as the first aspects discussed above.

Further, in an example embodiment of the invention, the means for providing back folded transverse seams may include a guiding plate arranged to indent covering material towards a centerline of the elongate string when the covering material is guided along the guiding plate. The guiding may be able to press the covering material back such that the covering material is back folded creating twice as many layers. The guiding plate is able to indent the covering material by being overlapped on both sides with covering material. Hereby, the back folding may be obtained in a relatively simple way, which is also easy to integrate as an in-line step in conventional pocket mattress manufacturing equipment.

In an example embodiment of the invention, the means for providing back folded transverse seams may further include a receiving plate having a recess with the corresponding shape of the guiding plate, the recess of the receiving plate being arranged to at least partly cover the guiding plate such that the covering material when guided along the guiding plate is folded into the recess of the receiving plate.

The receiving plate may be arranged between the layers of the elongate string. The receiving plate has a recess corresponding to the shape of the guiding plate. When the guiding plate indents the covering material, the covering material is pushed into the recess of the receiving plate creating back folded covering material. The covering material is arranged to be guided between the guiding plate and the receiving plate forming back folded covering material in at least and end portion of the elongate string along the longitudinal direction of the string.

In addition, the guiding plate may be arranged with rounded corners in the guiding direction to improve the ability of covering material to be guided along the guiding plate. The guiding direction of the guiding plate is the corner that first encounters the covering material. Hereby, movement of the covering material past the guiding plate is facilitated.

According to an aspect of the invention, there is provided a method for manufacturing a pocket string comprising the steps of providing a covering material forming an elongate string configured to enclose a plurality of coil springs arranged in succession; arranging coil springs in such a manner that they are enclosed by the covering material; providing a plurality of transverse seams across the elongate string, so that successive pockets are formed, and directed so that a longitudinal axis of the coil springs is parallel to the transverse seams and providing back folded transverse seams, prior to, concurrently or after the step of providing a plurality of transverse seams by back folding covering material in proximity to at least an end portion of said back folded transverse seams towards a middle portion of the transverse seams.

The method for manufacturing a pocket string comprises the same or similar advantages as the other aspects discussed above.

The step of arranging coils springs may take place after the step of providing a plurality of transverse seams or the step of providing a plurality of back folded transverse seams.

According to an embodiment of the invention, the step of providing back folded transverse seams material may further comprise the step of indenting covering material by overlapping at least part of a first and a second side of a guiding plate for back folding.

According to an embodiment of the invention, the step of arranging coil springs may take place after the step of back folding covering material.

According to an embodiment of the invention, the steps of arranging coil springs and providing a plurality of transverse seams may be carried out concurrently.

According to an embodiment of the invention, the method further comprises the step of providing a longitudinal seam along open ends of the elongate string in a longitudinal direction of the elongate string.

According to an embodiment of the invention, the method for manufacturing a pocket mattress may further comprise the steps of providing a plurality of pocket strings; and interconnecting the plurality of pocket strings side by side by surface attachment between abutting surfaces.

These and other advantages of the current invention will be evident from the following detailed description of specific embodiments.

BRIEF DESCRIPTION OF THE DRAWINGS

These and other aspects of the present invention will now be described in more detail, with reference to the appended drawings showing example embodiments of the invention, wherein.

DETAILED DESCRIPTION

The invention will be described in the following for exemplifying purposes by way of embodiments and with reference to the accompanying drawings.

Figure 1:
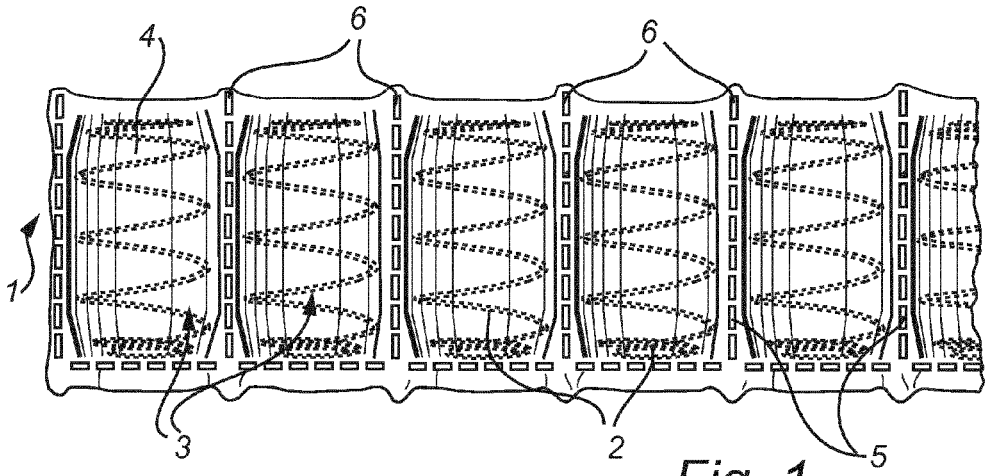
FIG. 1 is a side view of an example of a part of pocket mattress according to the prior art.

In FIG. 1 a pocket string 1 according to the prior art is illustrated, presenting false lofts 6. The pocket string 1 having coil springs 2 are enclosed in pockets 3 as spring units in succession by a covering material 4. The pockets 3 are separated by transverse seams 5 arranged parallel to the longitudinal direction of the coil springs 2 between each coil spring. Furthermore, the pocket string 1 is made of a folded covering material strip that is sealed by a longitudinal seam arranged along the longitudinal direction of the pocket string 1. Rectangular pocket are thus formed by the transverse and longitudinal seams and when an object such as a coil spring 2 is inserted into the pocket 3 the covering material 4 in proximity to the transverse seams 5 are protruding and creates an uneven surface comprising false lofts 6.

Figure 2A:
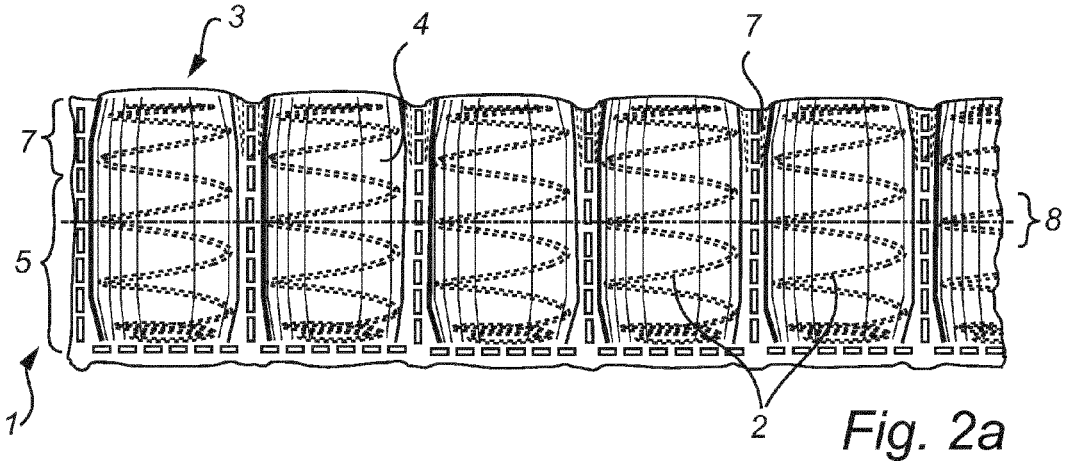
FIGS. 2*a* and 2*b* are side views of alternative embodiments of a pocket string to be used in a pocket spring mattress in accordance with the present invention.

In the following, with reference to FIG. 2-FIG. 7, different aspects of the invention are illustrated. In FIG. 2*a*, a pocket string 1 is illustrated as described above in FIG. 1 separating each coil spring in pockets 3. However, part of the covering material 4, in FIG. 2*a*, have been folded back to create back folded transverse seams 7 to avoid protruding false lofts 6. The covering material 4 arranged to be back folded, are located between end portions of successive coil springs 2, in the longitudinal direction of the coil springs 2. The back folded covering material 4 is folded towards a middle portion 8 of the transverse seams 5. The pocket string 1 is, in this example, made of a single layer of folded covering material arranged to enclose the springs, therefore the back folded transverse seams 7 attach four layers of covering material 4 while the transverse seams 5 attach two layers of covering material 4. Suitably, the covering material 4 is made from a preferably weldable textile fabric but other materials, such as various types of plastic material could equally well be used. It is likewise possible to use non-weldable textile fabrics, such as cotton fabrics. Normally, elongate strings of interconnected, cover-enclosed pocket coil springs 2 are manufactured automatically, whereupon the strings are cut into suitable lengths and joined together side by side to form mattresses.

In the embodiment shown in FIG. 2*a*, the string further comprises a longitudinal seam arranged at the lower end of the string, and being directed parallel to the length direction of the string, and perpendicular to the direction of the transverse seams and the axial direction of the enclosed springs. In such an embodiment, it is preferred, as is also illustrated in FIG. 2*a*, to provide the back folding in end portions arranged opposite to the longitudinal seam.

Figure 2B:
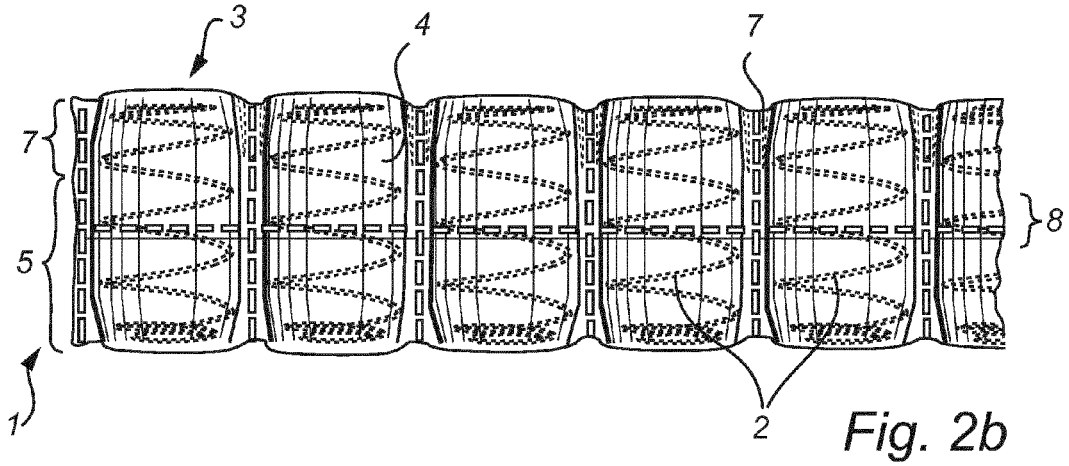

The embodiment shown in FIG. 2*b* is similar to the embodiment discussed above in relation to FIG. 2*a*. However, in this embodiment the longitudinal seam is not arranged in the lower end of the string, but on a side in the middle of the string. The longitudinal seam may e.g. be located close to the centre line of the string. In such an embodiment, back folding can easily be provided at end portions at both sides of the string, as is also illustrated in FIG. 2*b*.

At the back folded end portions, at least twice as many layers of covering material will be fixated by the transverse seam at the back folded end portions as in end portions of corresponding transverse seams without such back folding. In the embodiment of FIG. 2*a*, this also means that at least twice as many layers of covering material will be fixated by the transverse seam at the back folded end portions as in the middle part of the transverse seam. This also applies to the embodiment of FIG. 2*b*, apart from the overlap of cover material obtained at the location of the longitudinal seam.

Coil springs 2 of many different sizes could be used in conjunction with the present invention, and in principle any desired spring size, large or small, may be used. Preferably, however, the coil springs 2 used have a diameter in the range 2-10 cm, and preferably in the range 4-8 cm, such as 6 cm. In addition, the coil springs 2 are preferably manufactured from helically coiled wires. The springs preferably comprise at least three turns, and preferably fewer than 10 turns. Moreover they are advantageously made of spiral wire with a thickness in the range 0.5-3.0 mm, preferably a wire thickness in the range 1.25-2.50 mm. Preferably the springs are slightly spool-shaped, that is with smaller turns at the top and bottom.

The transverse seams 5 and back folded transverse seams 7 may be arranged as a continuous line, or in smaller sections or singular points, forming e.g. a dashed line or a dotted line, respectively. The seams are preferably formed by welding, but other connection methods may also be used.

Figure 3:
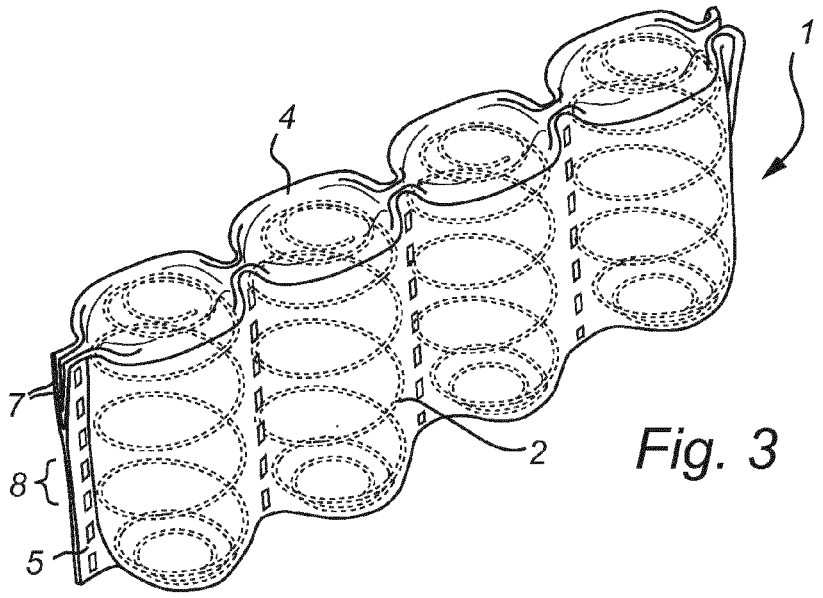
FIG. 3 is a perspective view of the pocket string of FIG. 2*a;*

Furthermore, FIG. 3 illustrates a perspective view of the pocket string 1. The back folded transverse seams 7 may thus be illustrated by the twice as many layers attached by the seams as the middle portion 8 of the transverse seams 5. The covering material 4, in proximity to the back folded transverse seams 7 being back folded, is arranged in between the rest of the covering material 4 enclosing the coil springs 2. By back folding the covering material of the end portion of the pocket string 1 in the longitudinal direction of the springs, the top end of the pocket string 1 has a smooth and an even surface without protruding false lofts. The back folded covering material attached with a back folded transverse seam may have the shape of an X when viewed from the above.

Figure 4:
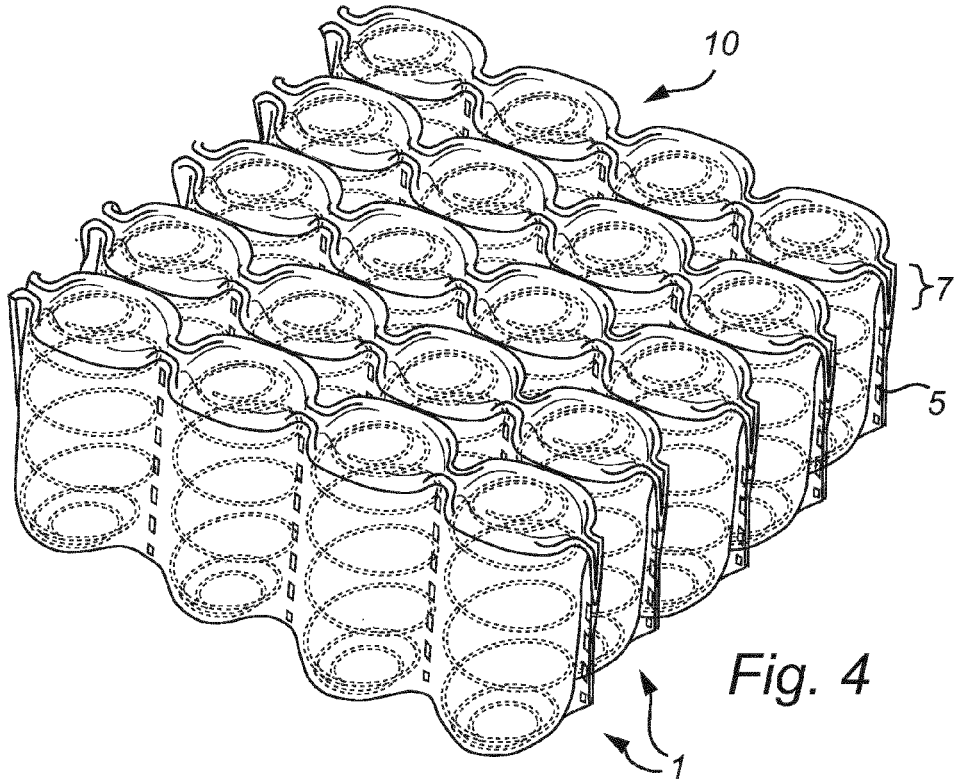
FIG. 4 is a perspective view of a part of a pocket mattress according to an embodiment of the present invention.

FIG. 4, a part of a pocket mattress 10 illustrates parts of pocket strings 1 presented in FIG. 3 joined together side by side in rows in succession. The surface attachment between the pocket strings 1 could be affected by welding, gluing, stitches and or clamping. Preferably, adhesive is used for this attachment.

Each of the pocket strings have transverse seams 5, of which at least some, and preferably all, are back folded transverse seams 7. The back folding of the back folded transverse seams 7 are arranged on the top surface of the pocket mattress, but may additionally also be arranged at the opposite surface.

Figure 5:
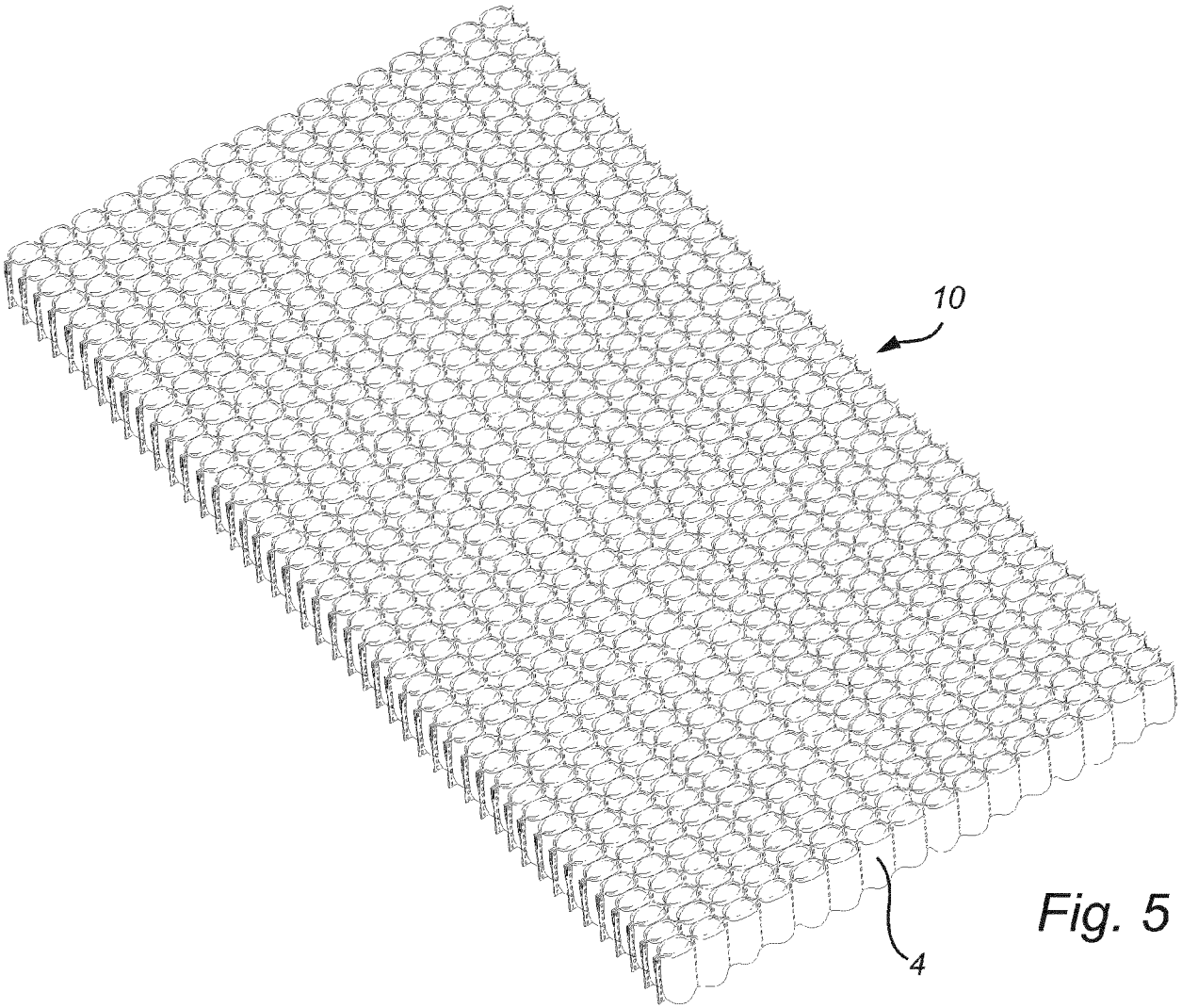
FIG. 5 is a perspective view of a pocket mattress according to an embodiment of the present invention.

In FIG. 5, a pocket mattress 10 is illustrated presenting a plurality of pocket strings 1 arranged side by side attached to each other. The plurality of pocket strings 1 used in the pocket mattress 10 is presented previously in FIG. 3. Furthermore, FIG. 4 illustrates the side by side attachment. The surface attachment of the rows of pocket strings 1 could also be affected by Velcro tape or some other suitable surface attachment method, as is per se known in the art.

FIG. 5 illustrates the smooth and the even surface of the pocket mattress 10. The even surface facilitates that an additional layer, such as a polyester sheet, may easily be attached to the covering material 4 on the surface of the pocket mattress.

Figure 6:
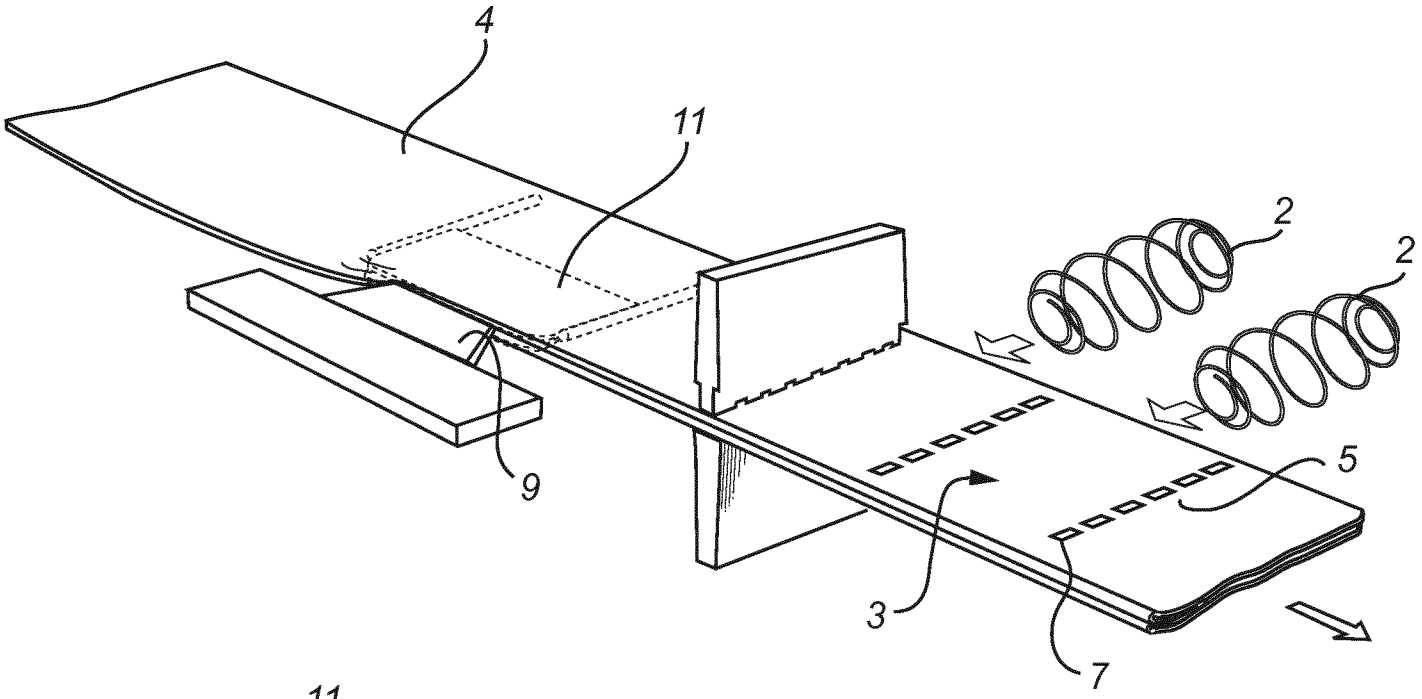
FIG. 6 is a schematic perspective view of an exemplary embodiment of a production device and a method for producing pocket strings in accordance with an embodiment of the present invention.

FIG. 6 illustrates an example of a production device and method for manufacturing pocket strings 1 with back folded transverse seams 7. An elongate string of covering material 4 is arranged in two layers. The receiving plate 11 may be placed such that it is surrounded by the elongate string, which is illustrated with dashed lines. The guiding plate 9 is placed on the outer side of the elongate string arranged in the recess of the receiving plate 11. The guiding plate 9 is used to indent the covering material 4 forming back folded covering material in the recess of the receiving plate 11. The back folded covering material comprise four layers of covering material 4. The layers of covering material 4 are then attached with transverse seams 5 in the middle portion 8 of the string and back folded transverse seams 7 across the back folded covering material. When the pockets 3 have been formed, coil springs 2 may be inserted expanding the pockets 3 creating a smooth and even surface. However, the steps illustrated in FIG. 6 may be done in a different order. For example, the steps of arranging the springs within the pocket material may be carried out before the step of providing back folding of the back folded transverse seams 7.

Figure 7:
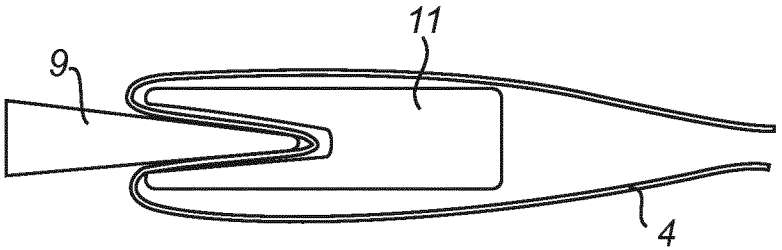
FIG. 7 is a cross-sectional view of the means for back folding covering material in FIG. 6.

FIG. 7 illustrates a side-view of the guiding plate 9 and the receiving plate 11 forming back folded covering material. The guiding plate 9, in FIG. 7, has a wedge shape arranged to indent the covering material 4 into the recess of the receiving plate 11 having a corresponding V-shape. The back folded covering material is, thus, indented in between the layers of covering material forming an M-shape or W-shape dependent on the viewing direction. However, the back folded covering material may also be folded on one of the outer sides of the covering material 4.

The invention has been described above by ways of embodiments. Several variants of the invention are, however, conceivable. For example, it is possible to provide back folding of the back folded transverse seams at both ends or only at one end. It is also possible to use back folded transverse seams in the entire mattress, whereby all transverse seams would constitute back folded transverse seams. However, it is also feasible to use a combination of back folded transverse seams and conventional transverse seams without back folding. E.g. such conventional transverse seams may be used around the edges of the mattress, or in certain zones of the mattress. It is also possible to use the pocket mattress without any additional upper layer, for use e.g. with non-attached layers, bed mattresses or the like. However, the pocket mattress preferably comprises at least one additional layer arranged on the top of the pocket mattress. The additional layer may be a padded layer, or a non-padded, thin layer. Furthermore the device and the method for manufacturing the pocket mattress can be designed in other ways than as in the illustrated example. For example, other means for providing the back folding are feasible, such as displaceable fingers or plates, which are moveable in a direction parallel to the transverse seams which are formed or about to be formed. It is further preferred that the back folded material is fixated in the transverse seam during forming of the transverse seam. Hereby, the transverse seam may be formed in a single step, in a conventional fashion. However, it is also possible to dual seam arrangement or the like. In this case, it is for example possible first to form a first transverse seam, thereafter provide a back folding, and subsequently adding a second seam, overlapping or nearly overlapping the first seam, to fixate the back folding. Such obvious variants must be considered to be comprised by the invention as defined by the appended claims.

The invention claimed is:

1. A pocket mattress, comprising:

coil springs arranged as spring units enclosed in a covering material forming pockets, the spring units being arranged successively in elongate strings, the mattress including a plurality of the elongate strings, interconnected and arranged side by side, the elongate strings including a plurality of transverse seams arranged parallel to a longitudinal direction of the coil springs to separate the pockets, wherein a middle portion of the transverse seams attaches at least a layer of covering material from either side of one of the spring units to each other, and wherein at least some of the transverse seams are back folded transverse seams, in which the covering material in proximity to an end portion of said back folded transverse seams is back folded towards the middle portion of the transverse seams, said back folded transverse seams each including at least one end portion attaching at least twice as many layers of covering material as in a corresponding transverse seam which is not back folded.

2. The pocket mattress of claim 1, wherein at least one of the back folded transverse seams include a first end portion and a second end portion both attaching at least twice as many layers of covering material as in a corresponding transverse seam which is not back folded.

3. The pocket mattress of claim 1, wherein the elongate strings are made of a covering material with a constant width.

4. The pocket mattress of claim 1, wherein the pocket mattress further comprises a layer attached to a surface of the pocket mattress including back folded transverse seams.

5. The pocket mattress of claim 1, wherein essentially all the transverse seams are back folded transverse seams.

6. The pocket mattress of claim 1, wherein the back folded transverse seams are formed by welding.

7. The pocket mattress of claim 2, wherein the elongate strings are made of a covering material with a constant width.

8. The pocket mattress of claim 2, wherein the pocket mattress further comprises a layer attached to a surface of the pocket mattress including back folded transverse seams.

9. The pocket mattress of claim 2, wherein essentially all the transverse seams are back folded transverse seams.

10. The pocket mattress of claim 2, wherein the back folded transverse seams are formed by welding.

* * * * *